US010045624B2

(12) United States Patent
Desanta et al.

(10) Patent No.: US 10,045,624 B2
(45) Date of Patent: Aug. 14, 2018

(54) LUMBAR SUPPORT FOR A CHAIR, AND CHAIR HAVING SAME

(71) Applicant: Haworth, Inc., Holland, MI (US)

(72) Inventors: Simon Desanta, Borgholzhausen (DE); Mark Wiese, Ahlen (DE)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 15/518,962

(22) PCT Filed: Oct. 13, 2015

(86) PCT No.: PCT/EP2015/073637

§ 371 (c)(1),
(2) Date: Apr. 13, 2017

(87) PCT Pub. No.: WO2016/059030

PCT Pub. Date: Apr. 21, 2016

(65) Prior Publication Data

US 2017/0231397 A1 Aug. 17, 2017
US 2018/0042385 A9 Feb. 15, 2018

(30) Foreign Application Priority Data

Oct. 13, 2014 (DE) ..... 10 2014 220 693

(51) Int. Cl.
*A47C 7/46* (2006.01)

(52) U.S. Cl.
CPC ..... *A47C 7/462* (2013.01)

(58) Field of Classification Search
CPC ..... A47C 7/462; A47C 7/46; B60N 2/66
USPC ..... 297/284.4
See application file for complete search history.

(56) References Cited

U.S. PATENT DOCUMENTS 2,756,809 A * 7/1956 Ernst ..... A47C 7/462 297/284.7
3,288,525 A * 11/1966 Cerf ..... A47C 7/462 297/284.8
2013/0001993 A1 1/2013 Kurata et al.

FOREIGN PATENT DOCUMENTS

GB 000360516 A * 12/1931
JP H0284549 6/1990

OTHER PUBLICATIONS

International Search Report of International Application PCT/EP2015/073637, dated Jan. 20, 2016.

* cited by examiner

*Primary Examiner* — Milton Nelson, Jr.
(74) *Attorney, Agent, or Firm* — Warner Norcross + Judd LLP

(57) ABSTRACT

The invention relates to a lumbar support (1) for a chair with a backrest comprising backrest carriers (7) which are pivotable independently of each other, wherein the lumbar support comprises support regions (10*a*, 10*b*) which are each mounted on a spring element (2). The spring action of each spring element (2) is individually adjustable. In this arrangement, the spring elements (2) are arranged on a carrier (5), which can be articulated to the backrest carriers (7) of the backrest of the chair, which are pivotable independently of each other. The invention further relates to a chair with a backrest, which is formed from backrest carriers (7) which are pivotable independently of each other and which also comprises the aforementioned lumbar support (1). In this case, the lumbar support (1) is articulated to the backrest carriers (7) which are pivotable independently of each other.

7 Claims, 7 Drawing Sheets

LUMBAR SUPPORT FOR A CHAIR, AND CHAIR HAVING SAME

Figure 1:
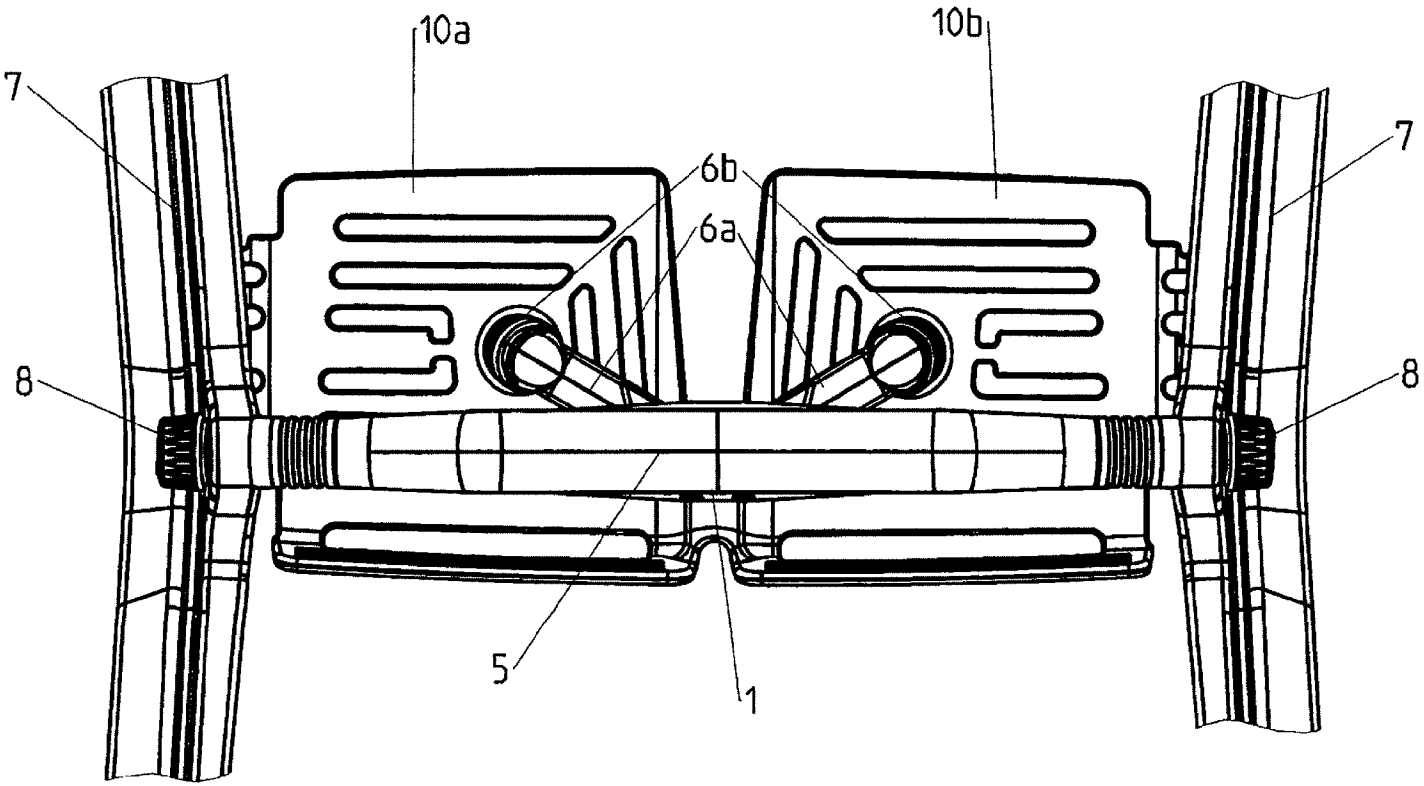

The invention relates to a lumbar support for a chair with a backrest which has independently adjustable pivotable backrest carriers, wherein the action of individual support regions of the lumbar support are individually adjustable. Furthermore, the invention relates to a chair having such a lumbar support.

Chairs with a backrest, which have independently pivotable backrest carriers, are known, for example, from WO 2014/029696 A1. Such chairs can adjust forces acting on one side against the backrest, which often occur when chairs are used. The adaptation of the chair to a laterally altered body position of the user increases the sitting comfort for said user.

Furthermore, it is known from the prior art to provide the backrest of chairs with so-called lumbar supports in order to support the hip region or lumbar region of a seated person. Known lumbar supports are usually designed to be depth-adjustable, i.e. an adjustment of the lumbar support position occurs at right angles to the backrest region and thus an adjustment to the back of the seated person towards or away from it. However, such lumbar supports are perceived as inconvenient by many users.

Another approach for a lumbar support is known, for example, from WO 2006/094261 A2 wherein a lumbar support is arranged centrally on a rigid backrest frame and support regions are arranged on leaf spring halves in order to adjust the force exerted on the lumbar region of a user independently of each other for each support region. For this purpose, carrier blocks are provided which are displaceable independently of one another for each spring half so as to adjust the spring force of the spring halves and thus the resistance to displacement of the individual support regions.

However, the lumbar support shown in WO 2006/094261 A2 can only be used for chairs with a rigid backrest frame because it is arranged centrally on the backrest frame and thus no adjustment of the lumbar support position to independent pivoting of the supports of the backrest of the chair is possible.

It is therefore the object of the invention to provide a lumbar support which is suitable for a chair with a backrest comprising backrest carriers which are pivotable independently of each other. It is furthermore an object of the invention to provide a chair which can adjust itself to forces acting on one side against the backrest and, on the other hand, can support the hip region or lumbar region of a person sitting on the chair.

The object is achieved according to a first aspect by a lumbar support with the features of claim 1.

The lumbar support according to the invention has support regions which are each mounted on a spring element, wherein the spring action of each spring element is individually adjustable. In this arrangement, the spring elements are arranged on a carrier, which can be articulated to the backrest carriers of the backrest of the chair, which can be pivoted independently of each other.

The lumbar support according to the invention makes possible on the one hand an individual, in particular asymmetrical, adjustment of the support effect directed to the hip region or the lumbar region of a seated person through the lumbar support. On the other hand, the structural design of the lumbar support according to the invention makes it possible to use the same with a chair, whose backrest comprises backrest carriers which can be pivoted independently of each other. Due to the articulated connection of the lumbar support to the backrest carriers of the chair which can be pivoted independently of each other, the position of the lumbar support within the backrest can simply be adapted to the instantaneous tilting of the backrest carriers. By supporting the hip region or the lumbar region of a seated person, in particular also in a sitting position, which exerts only a force on the backrest of the chair on one side, the seat comfort for a user can be increased. In addition, the support effect for the individual support areas of the lumbar support can be individually adapted so that the personal preferences or needs of a user of the chair can be satisfied. Thereby the seat comfort of a user can be further increased.

In an advantageous embodiment, the spring element comprises a leaf spring. In particular, the spring action can be adjusted via a bearing element which can be moved along a longitudinal axis of the leaf spring. Preferably, the bearing element is moved along the longitudinal axis of the leaf spring by means of a tapping mechanism.

By the use of leaf springs as spring elements, a particularly simple mounting of the support regions and also a very simple adaptation of the desired resistance of the individual support regions is possible. By means of the adjustable bearing element, in particular the curvature point of the leaf spring can be adapted according to the needs, so that the spring force acting on the lumbar region of the sitting person by means of the support regions can be continuously adjusted to the needs of the user. It is in particular possible to adjust individual support regions independently of each other so that, for example, an asymmetrical support effect on the lumbar region of a seated person relative to the two lateral ends of the backrest of a chair is possible.

Advantageously, the support regions are each mounted on the associated spring element by means of a lever mechanism. In particular, the support regions can be moved in a synchronous manner relative to the carrier via a gear unit operatively connected to the respective lever mechanism. The support regions are preferably formed in such a way that they can engage in guides in the backrest carriers which are pivotable independently of each other.

The lever mechanism and the gear unit operatively connected to the lever mechanism allow movement of the support regions relative to the carrier. This makes it possible, in particular, to adjust the height of the support regions when the lumbar support is connected to the backrest carriers of a chair. Thus, the spring force acting on the lumbar region of the seated person by means of the support regions can be adapted to the individual needs of the seated person.

According to a second aspect of the invention, a chair is provided with a backrest which comprises backrest carriers which are pivotable independently of each other, wherein a lumbar support according to the invention is connected in an articulated manner to the backrest carriers which are pivotable independently of each other. Preferably, the backrest carriers each have guides for the support regions of the lumbar support.

The chair according to the invention allows an increased seat comfort for a user, since said user can adapt to the forces acting on one side of the backrest by means of the backrest carriers which are pivotable independently of each other. On the other hand, the position of the lumbar support is adapted to the instantaneous position or tilt of the backrest of the chair by means of the articulated bearing on backrest carriers which are pivotable independently of each other. By means of this adaptation, a support of the hip region or the lumbar region of a seated person can be achieved in every position or tilting of the backrest, so that a particularly comfortable sitting is possible for the seated person.

Specific embodiments of the invention are explained in more detail below with reference to the drawings. Identical or equivalent elements are identified by the same reference symbol.

Figure 2:
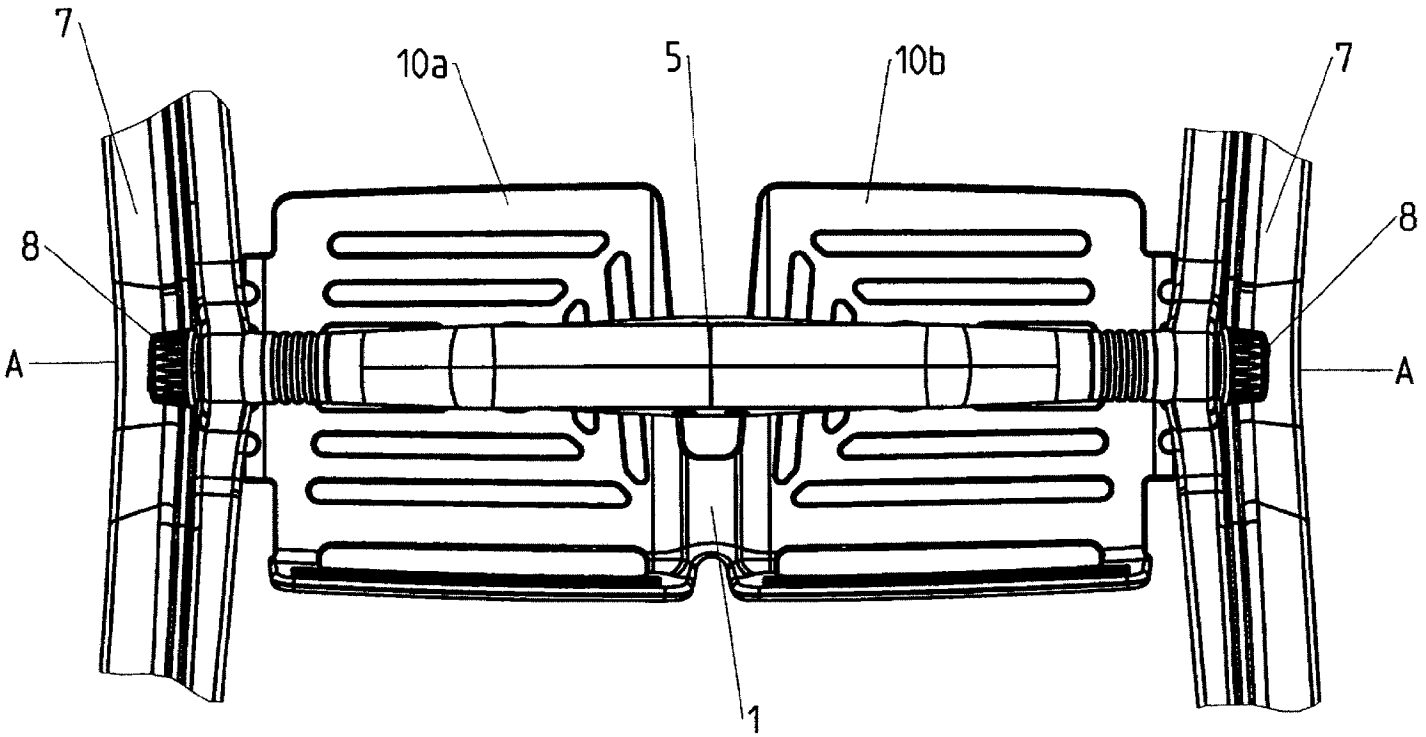
Figure 3:
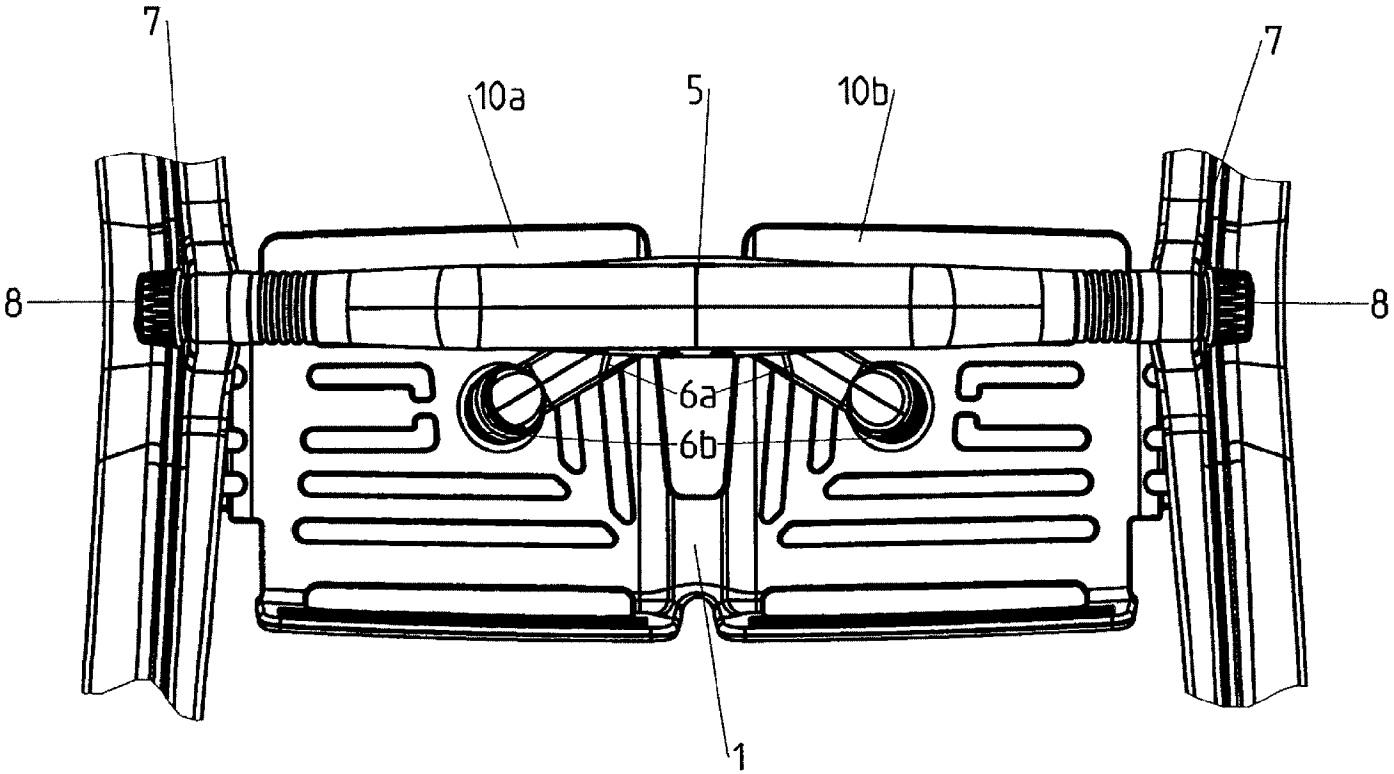
Figure 4:
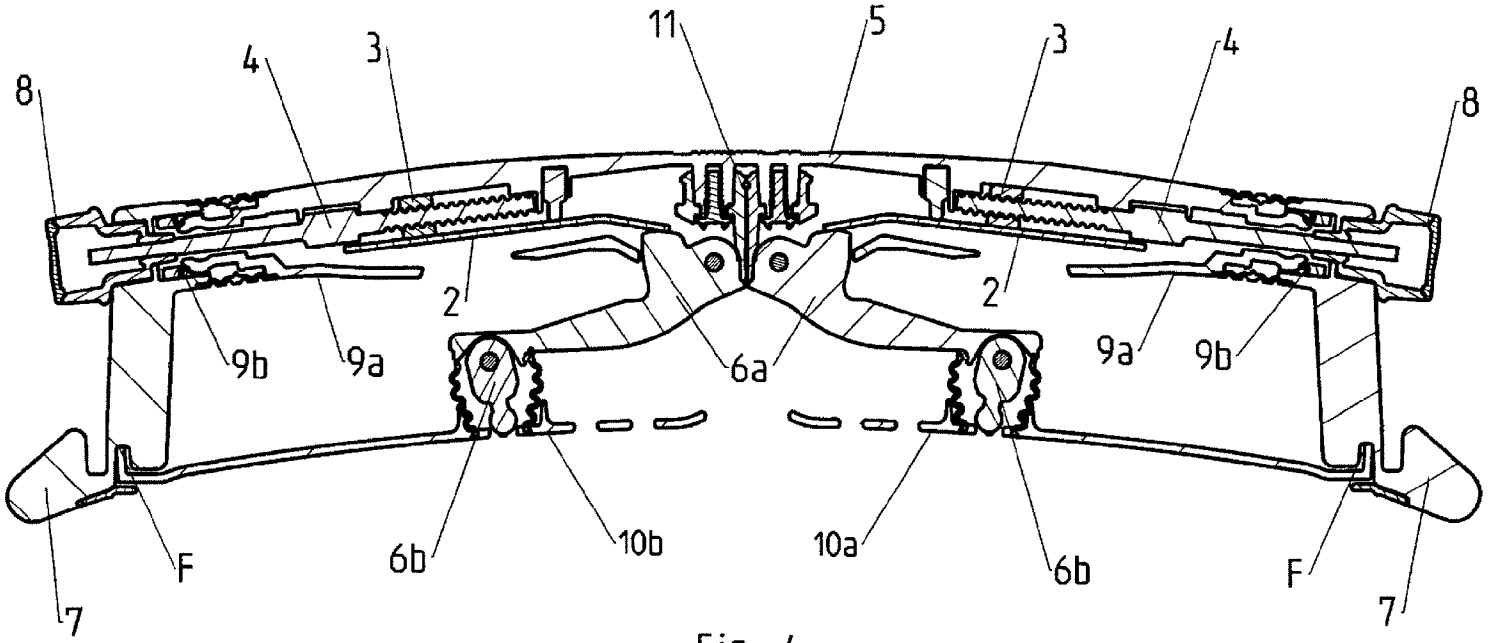
Figure 5:
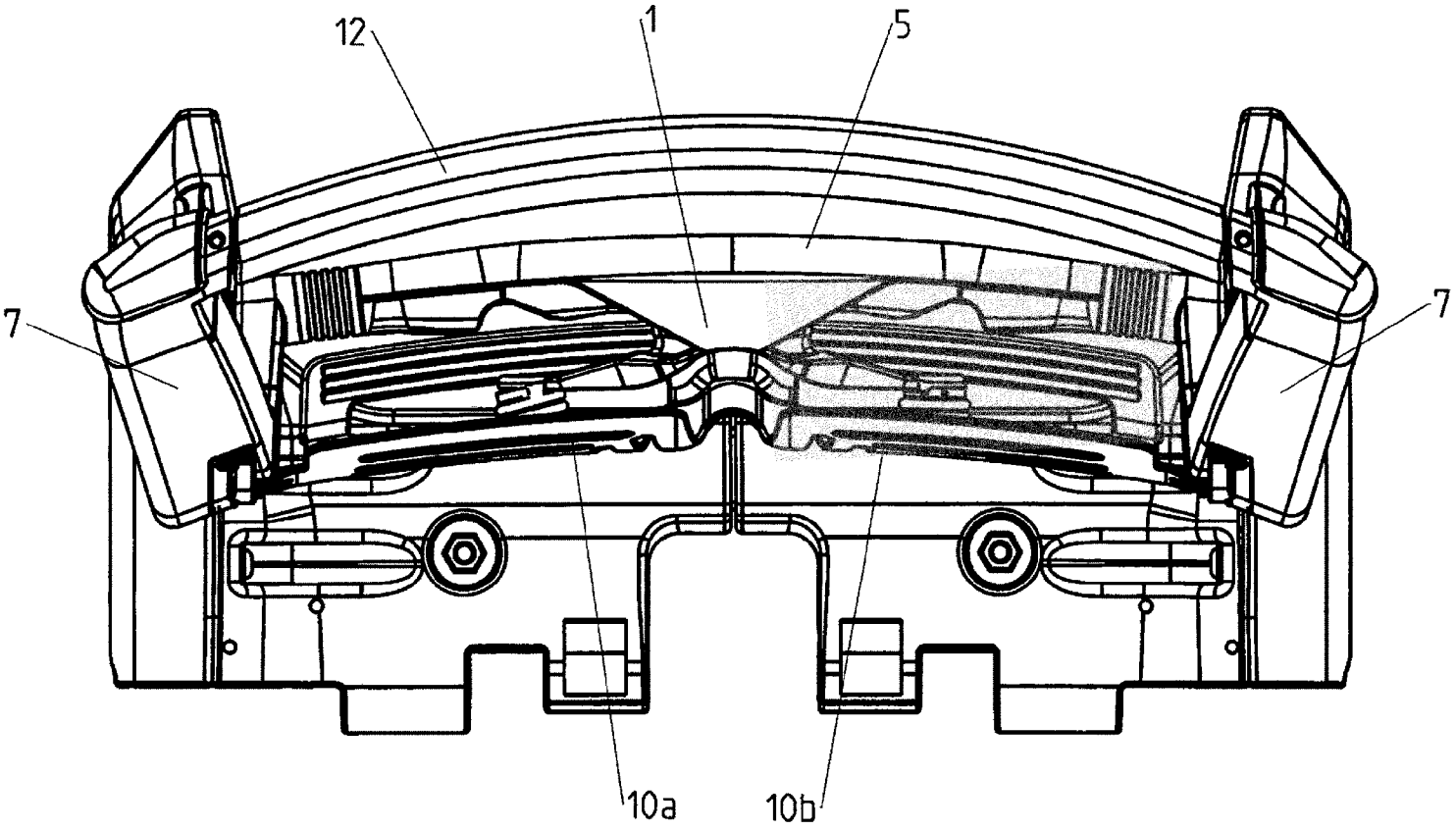
Figure 6:
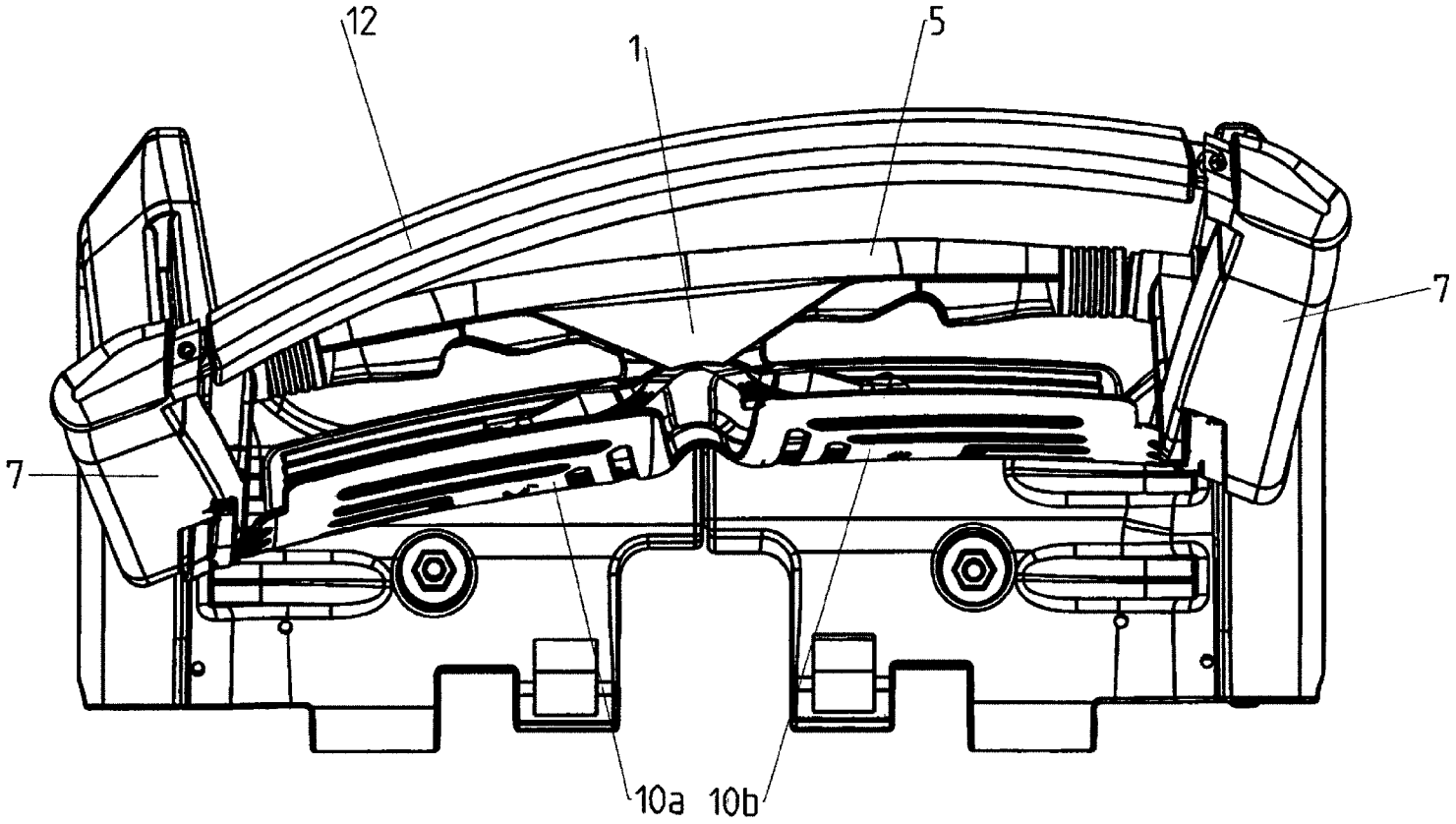
Figure 7:
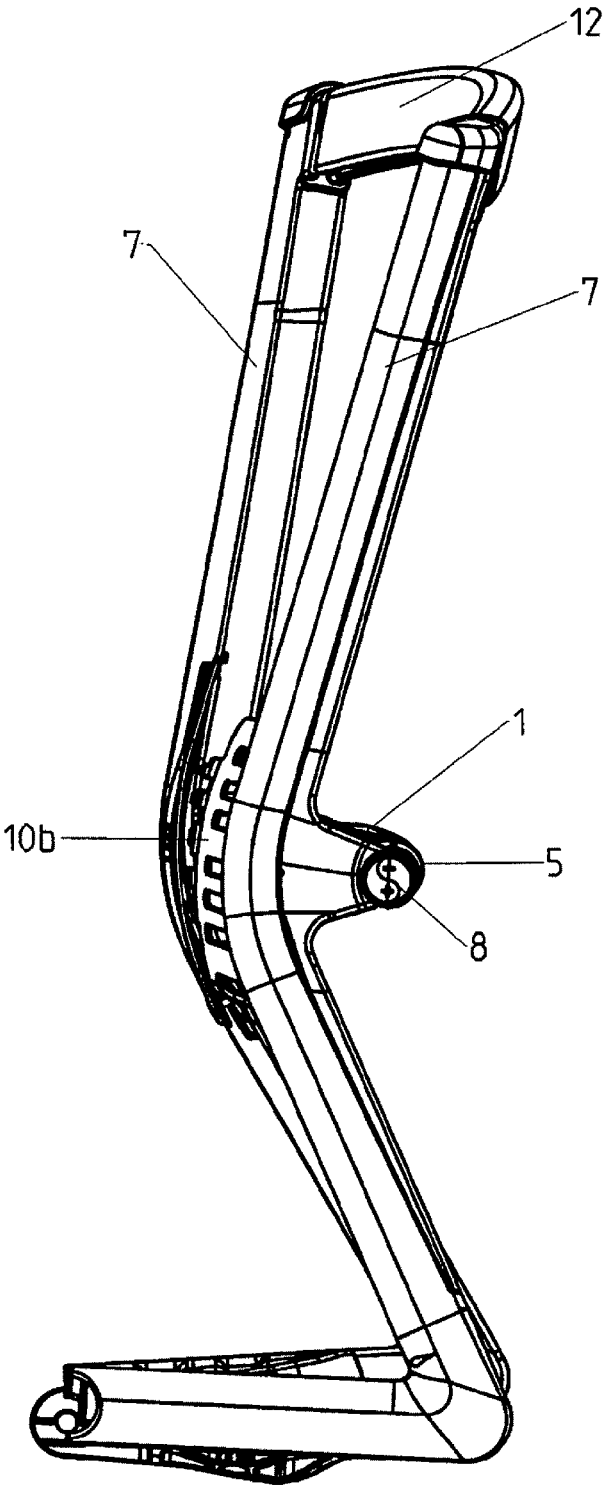

They show:

FIG. 1 a schematic rear view of the lumbar support according to the invention in an upper position;

FIG. 2 a schematic rear view of the lumbar support according to the invention in a middle position;

FIG. 3 a schematic rear view of the lumbar support according to the invention in a lower position;

FIG. 4 a sectional view of the lumbar support according to the invention taken along the line A-A in FIG. 2;

FIG. 5 a schematic plan view of the chair according to the invention;

FIG. 6 a schematic plan view of the chair according to the invention in a position of the backrest which is inclined at one side; and FIG. 7 a schematic side view of the chair according to the invention in a position of the backrest which is inclined at one side.

The lumbar support 1 shown in FIG. 4 has two support regions 10*a*, 10*b* which are each mounted on a spring element 2, which is designed as a leaf spring, via a lever 6*a* and a coupling member 6*b*. The spring element 2 is, in turn, arranged on a carrier 5, to which the two support regions 10*a*, 10*b* are also connected. The design of the individual support regions 10*a*, 10*b* is known from the state of the art and will not be discussed further in the following.

On each of the leaf springs 2 is arranged in each case a movable bearing element 3, which is movable along a longitudinal axis of the leaf spring 2. In the embodiment shown, the position of the bearing element along the longitudinal axis of the leaf spring 2 is adjusted via a steep-thread spindle 4. In general, the position of the bearing element 3 can be adjusted by any arbitrary threading mechanism. The steep-angle spindle 4 is operable by a user via a control element 8. The operating element can, for example, be configured as a rotary knob.

If, for example, a force acts on the support region 10*a*, this is transferred to the spring element 2, on which the support region 10*a* is mounted. Due to the action of the force, the spring element is curved at the position of the bearing element 3, and the lumbar region which exerts the force on the supporting region 10*a*, is supported by the latter. By the movement of the bearing element 3 along the leaf spring 2, the point of curvature can be displaced along the longitudinal axis of the leaf spring 2 so that the spring action of the leaf spring 2 can be adjusted infinitely. Thus, the force acting on the lumbar region of a seated person can be adjusted according to his/her desires or preferences, wherein no adjustment takes place in the depth direction, i.e. in the direction of the surface normal of the seat back. In the lumbar support 1 shown in FIG. 4, the support region 10*a* is responsible, for example, for supporting the lumbar region located to the left of the spine of a seated person, and the support region 10*b* for the lumbar region to the right of the spine of a seated person. A uniform support effect by the two support regions 10*a*, 10*b* on the lumbar region is perceived as unpleasant by many individuals so that an asymmetrical adjustment of the support action of the lumbar support adapted to the individual needs of the seated person is advantageous. By means of the position of the bearing element 3 adjustable via the tapping mechanism along the longitudinal axis of the spring element 2, the supporting action of the individual supporting regions 10*a*, 10*b* can be adjusted individually to the needs of a seated person.

Furthermore, FIG. 4 shows the bearing of the lumbar support 1 in the backrest carriers 7 of a chair. In this case, regions of the carrier 5 of the lumbar support 1, which are in engagement with the backrest carriers 7, are designed as a joint head 9*a*. Furthermore, regions of the backrest carriers 7, which are in engagement with the lumbar support 1, are designed as an joint socket 9*b*, so that an articulated connection is provided between the lumbar support 1 and the backrest carriers 7.

FIG. 4 also shows that the support regions 10*a*, 10*b* are bearing on the associated spring elements 2 via coupling members 6*b* and levers 6*a*. The levers 6*a* are thereby operatively connected to a synchronized gear 11 so that a synchronous movement of the support regions 10*a*, 10*b* via the levers 6*a* and the coupling members 6*b* relative to the carrier 5 is possible.

FIG. 1 shows an upper position of the support regions 10*a*, 10*b* relative to the carrier 5 of the lumbar support 1. FIG. 2 shows a middle position of the support regions 10*a*, 10*b*, and FIG. 3 shows a lower position of the support regions 10*a*, 10*b* relative to the carrier 5. In FIGS. 1 to 3, the lumbar support 1 is in each case connected to backrest carriers 7 of a chair. As can be seen from FIGS. 1 to 3, the height of the support regions 10*a*, 10*b* relative to the carrier 5 of the lumbar support 1 can be adjusted within the backrest of a chair by the movement of the support regions 10*a*, 10*b*. Thus, the height position of the support regions 10*a*, 10*b* can be adapted to the needs of a user of the chair. By the use of the synchronized gear 11, the levers 6*a* move along a circular path during a height adjustment of the support regions 10*a*, 10*b*. As seen in FIG. 4, the support regions 10*a*, 10*b* are guided in guides F of the backrest carriers 7 so that the support regions 10*a*, 10*b* perform a linear movement during a height adjustment. In order to provide a compensation between the circular movement of the levers 6*a* and the linear movement of the support regions 10*a*, 10*b*, coupling members 6*b* are provided. With the above-described design, a simple, synchronous height adjustment of the support regions 10*a*, 10*b* is possible.

FIG. 5 shows a chair according to the invention with backrest carriers 7, pivotable independently of one another, which are connected by means of a strut 12 at one end. The backrest carriers 7 are connected at their other end to a pivoting mechanism of the chair. Furthermore, the chair comprises the previously described lumbar support 1, which, as shown in FIG. 4, is articulated in the backrest carriers 7.

FIG. 6 shows the chair according to the invention in a position of the backrest, which is formed from the backrest carriers 7 which can be pivoted independently of each other. Due to the articulated bearing of the lumbar support 1 in the two backrest carriers 7, the orientation of the lumbar support 1 can be adapted to the position of the backrest of the chair which is inclined at one side so that even in this position of the backrest a needs-based support for the lumbar region of a seated person through the support regions 10*a*, 10*b* is possible.

As can be seen from FIG. 7, the articulated bearing of the lumbar support 1 in the backrest carriers 7 makes it possible on the one hand to move the lumbar support in a forward-backward direction relative to the chair and in a top-down direction relative to the chair. Because of the articulated bearing, the lumbar support 1 can follow each movement of the independently pivotable backrest carriers 7 so that the support regions 10*a*, 10*b* are each ideally adapted to the sitting position of a user of the chair. The hip region or the lumbar region of a seated person can thus be supported needs-based in any possible position of the backrest formed from the backrest carriers 7 which are pivotable independently of each other.

For reasons of clarity, the backrest of the chair is shown in the figures only with the backrest carriers and the strut connecting the backrest carriers. However, it is self-evident that a suitable covering of an elastic material may be provided. Furthermore, for reasons of clarity, the chair is shown only with the backrest carriers and a partial region of the floor plate. Further structural details of the bearing of the backrest carrier have been omitted in the description.

LIST OF REFERENCE SYMBOLS

1 lumbar support
2 spring element
3 bearing element
4 tapping mechanism
5 carrier
6*a* levers
6*b* coupling member
7 backrest carriers
8 operating element
9*a* joint head
9*b* joint socket
10*a* support region
10*b* support region
11 synchronous gear unit
12 strut
F guide

The invention claimed is:

1. A lumbar support (1) for a chair with a backrest which includes backrest carriers (7) which are pivotable independently of each other, wherein the lumbar support comprises:

support regions (10*a*, 10*b*);

spring elements (2), wherein the support regions (10*a*, 10*b*) are each mounted resiliently on a separate spring element (2), each said spring element (2) having a spring action, wherein the spring action of each spring element (2) is individually adjustable by adjusting a position of a bearing element (3) along a length of the spring element (2) to adjust a force acting on a lumbar region of a seated person; and a carrier (5), each of the spring elements arranged on the carrier (5), wherein the carrier can be articulated vertically up and down along the backrest carriers, which are pivotable independently of each other.

2. The lumbar support according to claim 1, wherein the spring elements (2) each comprise a leaf spring (2).

3. The lumbar support according to claim 2, wherein the spring action is adjustable via the bearing element (3) movable along a longitudinal axis of the leaf spring (2).

4. The lumbar support according to claim 3, wherein the bearing element is moved along the longitudinal axis of the leaf spring (2) via a tapping mechanism (4).

5. The lumbar support according to claim 1, wherein the support regions (10*a*, 10*b*) are each mounted on the associated spring element (2) by means of a lever mechanism (6*a*, 6*b*).

6. The lumbar support according to claim 5, wherein the support regions (10*a*, 10*b*) are movable relative to the carrier (5) synchronously via a gear unit (11) operatively connected to the respective lever mechanism (6*a*, 6*b*).

7. The lumbar support according to claim 1, wherein the backrest carriers each include a guide, and the support regions (10*a*, 10*b*) are each formed in such a way that they can engage in the guides in the backrest carriers (7).

* * * * *